United States Patent [19]

Craig et al.

[11] Patent Number: 4,700,260

[45] Date of Patent: Oct. 13, 1987

[54] DEGAUSSING COIL AND GROUND STRAP MOUNTING ARRANGEMENT

[75] Inventors: Randy W. Craig; William E. Duvall, both of Indianapolis, Ind.

[73] Assignee: RCA Corporation, Princeton, N.J.

[21] Appl. No.: 869,093

[22] Filed: May 30, 1986

[51] Int. Cl.[4] ..... H01H 47/00; H01J 29/06

[52] U.S. Cl. ..... 361/150; 315/8

[58] Field of Search ..... 361/150; 315/8

[56] References Cited

FOREIGN PATENT DOCUMENTS 0106286 6/1985 Japan ..... 315/8

0233990 11/1985 Japan ..... 361/150

*Primary Examiner*—L. T. Hix

*Assistant Examiner*—David Porterfield

*Attorney, Agent, or Firm*—Paul J. Rasmussen; Joseph J. Laks; Scott J. Stevens

[57] ABSTRACT

A mounting and retaining assembly for a degaussing coil and ground strap for use on a cathode ray tube includes a flexible wire form that is held in place by the tube tension band. The wire is bent to form separate regions that receive the degaussing coil and ground strap. When the degaussing coil and ground strap are in place, the wire is under tension which holds the degaussing coil and ground strap firmly against the rear surface of the tube. The mounting and retaining assembly also includes retaining clips that cooperate and are held in place by the tube mounting lugs. The clips incorporate retaining loops that also receive and retain the degaussing coil and ground strap at other points.

11 Claims, 7 Drawing Figures

DEGAUSSING COIL AND GROUND STRAP MOUNTING ARRANGEMENT

This invention relates to video display apparatus and, in particular, to positioning and mounting of degaussing coils on video display apparatus cathode ray tubes.

In order to counteract the effects of the earth's magnetic field and nearby electromagnetic fields on the electron beam landing positions of a cathode ray tube in a video display apparatus, it is necessary to periodically demagnetize or degauss the metallic portions of the cathode ray tube and video display apparatus. Degaussing is accomplished by passing a decaying alternating current through a wire coil that is distributed about the cathode ray tube. Typically this occurs each time the video display apparatus, such as a television receiver, is energized or turned on.

It is important that the degaussing coil be positioned properly on the tube to insure complete degaussing. This is particularly important for cathode ray tubes having large deflection angles and/or tubes having small phosphor element spacing or pitch, which provide little tolerance for electron beam landing errors.

It is also desirable to be able to assemble as much of the video display apparatus as possible using automated or robotic assemblers. One example of this automating trend is the locating and mounting of the cathode ray tube within the cabinet of the video display apparatus. It is important, therefore, that the positioning and mounting arrangement for the degaussing coil, and also the cathode ray tube grounding lead or strap, do not undesirably interact with the cathode ray tube mounting equipment. In order to fully realize the efficiencies of automated assembly, it is also desirable that the degaussing coil and ground strap mounting be effected in as simple and efficient manner as possible, for example, by reducing both the number of assembly and mounting parts and the number of assembly operations or steps.

In accordance with an aspect of the present invention, an arrangement for a video display apparatus comprises a cathode ray tube having a circumferential band disposed about the perimeter of the tube under a predetermined amount of tension.

An electrical conductor is disposed about the rear of the tube and is capable of being electrically connected to circuitry associated with the video display apparatus. Structure fixes the position of a first portion of the electrical conductor with respect to the tube. An elongated flexible member has first and second ends that cooperate with the tension and in order to hold the flexible member in place. The flexible member has a hook portion intermediate the ends that receives and retains the electrical conductor in order to fix the position of a second portion of the electrical conductor with respect to the tube.

In the accompanying drawing.

Figure 1:
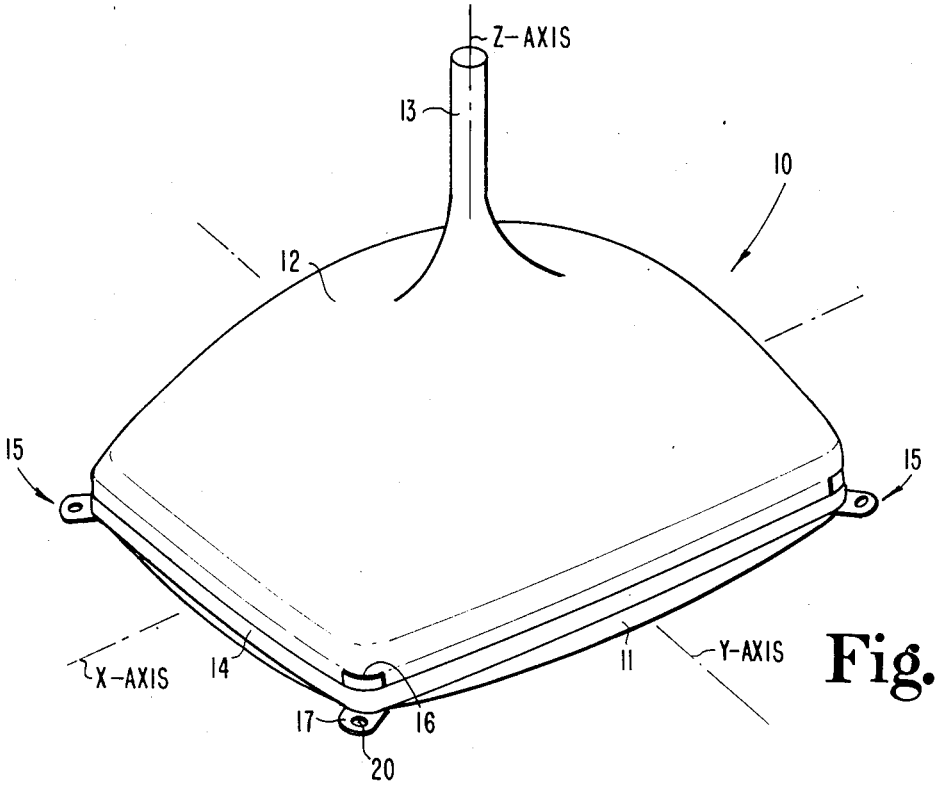
FIG. 1 is an isometric view of a conventional cathode ray tube.

Referring to FIG. 1, a cathode ray tube 10 comprises an evacuated glass enclosure that defines a front panel 11, a conical funnel region 12 and a neck region 13. About the periphery of the front panel, in the vicinity of its attachment to the funnel region, is located a circumferential metal strip or band 14. This band is applied under tension, typically of the order of 22 ft/lb, and acts to quickly collapse the front panel in the event of tube implosion to prevent glass dispersion. A tube mounting lug 15 is located at each of the corners of the front panel 11. Each of the mounting lugs 15 comprises a lug portion 16 that extends in a direction parallel to the longitudinal of z-axis of the cathode ray tube 10. This lug portion 16 is disposed between the side of front panel 11 and tension band 14 so that tension bend 14 holds lug 15 tightly in place. A second part 17 of lug 15 is located at right angles to lug portion 16 and is oriented parallel to the X-Y axes plane. Part 17 of lug 15 has a hole 20 formed therein for receiving a screw or other suitable fastener for mounting the cathode ray tube 10 within a cabinet (not shown) or other enclosure.

Figure 2:
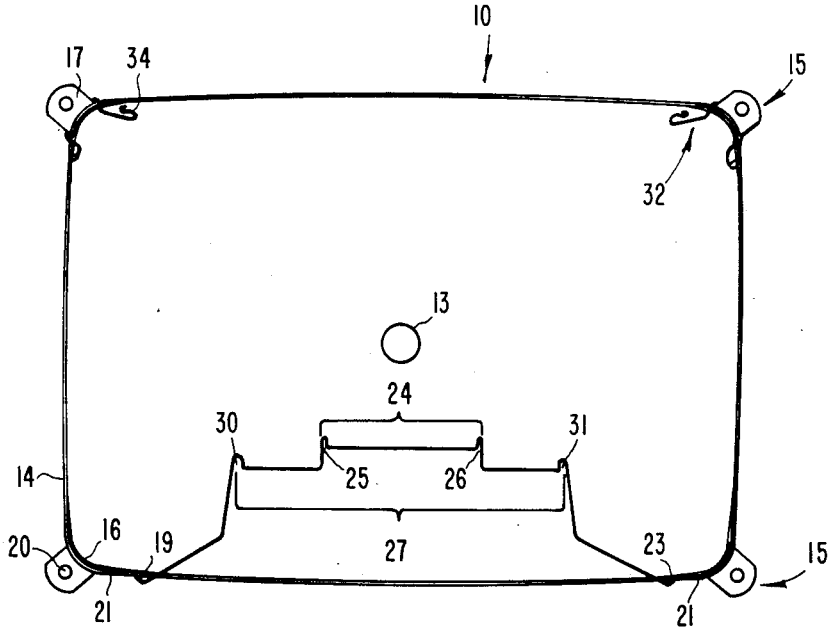
FIG. 2 is a rear elevational view of the cathode ray tube shown in FIG. 1, incorporating an aspect of the mounting arrangement of the present invention.
Figure 3:
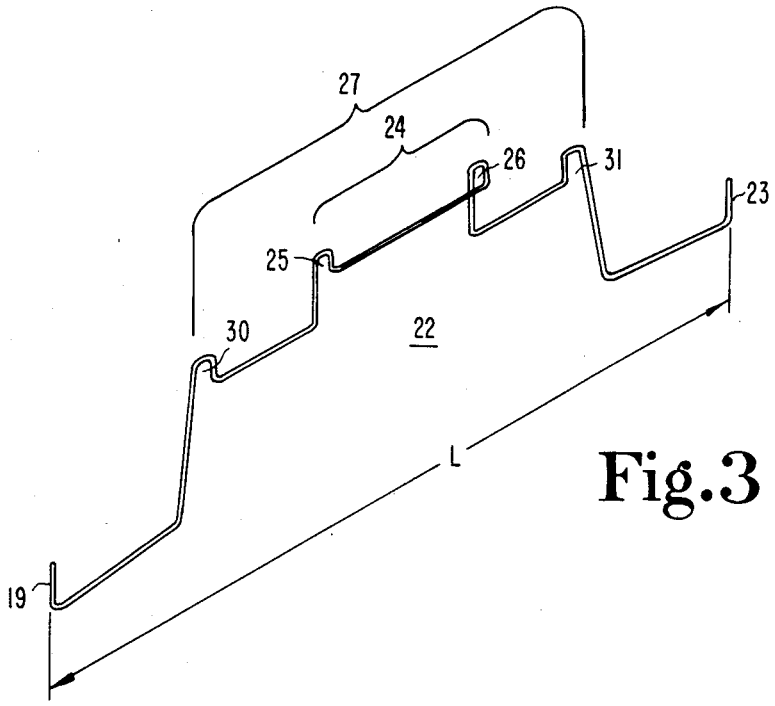
FIG. 3 illustrates an isometric view of one aspect of the mounting arrangement shown in FIG. 2.

FIG. 2 shows a rear view of the cathode ray tube 10. As tension band 14 passes over lug portion 16 of mounting lugs 15, the thickness of the material of lug portion 16 causes a slight gap 21 to be formed between tension band 14 and the surface of front panel 11 of cathode ray tube 10. In accordance with an aspect of the present invention, a mounting and securing element or member 22, illustratively manufactured of a flexible, resiliant material, such as heavy piano wire, has engagement end portions 19 and 23 that fit between tube front panel 11 and tension band 14 within gaps 21. The overall length of flexible element 22, designated L in FIG. 3, is slightly less than the distance between the gaps 21 that respectively receive the engagement end portions 19 and 23 of element 22. Element 22 is required to be stretched, therefore, to allow end portions 19 and 23 to be placed within gaps 21. The tension imparted to element 22 due to this stretching maintains element 22 in place without additional means. Mounting lugs 15 may be attached to the outside of band 14 via an appropriate technique such as spot welding, for example. With an arrangement of this type, band 14 closely follows the contour of the perimeter of front panel 11, such that no gaps occur between band 14 and front panel 11. Element 22 may then be formed such that ends 19 and 23 form hooks that engage part 17 or lugs 15 in order to hold element 22 in position in a similar manner to that previously described.

Element 22 incorporates a first captivating region 24 that forms a hook defined by partial loops 25 and 26, and a second captivating region 27 that forms a hook defined by partial loops 30 and 31. The purpose and operation of captivating or hook regions 24 and 27 will be explained in detail later.

Figure 4:
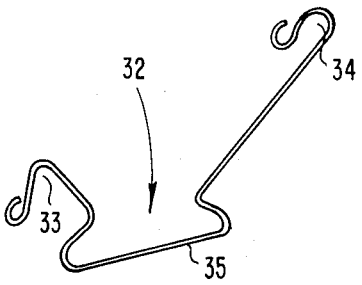
FIG. 4 is an isometric view of another aspect of the mounting arrangement shown in FIG. 2.
Figure 4A:
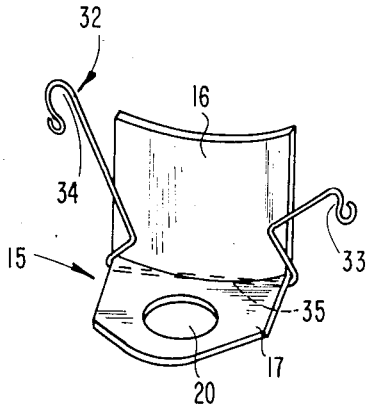
FIG. 4A illustrates an aspect of the operation of the mounting arrangement shown in FIG. 2.

In accordance with another aspect of the present invention, FIG. 4 illustrates a retaining clip 32 illustratively manufactured of stiff wire, and having a first retaining or hook portion 33 and a second retaining or hook portion 34. A clip portion 35 is shaped to flexibly snap around the second part 17 of mounting lugs 15, as shown in FIG. 4A and be maintained in position thereby. Retaining clip 32 is illustrated as being asymmetrical about clip portion 35. Retaining clip 32 is therefore intended to be specifically positioned about a particular mounting lug, 15*a* in FIG. 5, at one corner along the top edge 37 of front panel 11. A second retaining clip 36, having a mirror image appearance as that of retaining clip 32, is intended to be positioned about mounting lug 15*b* at the opposite corner along top edge 37 of front panel 11.

Figure 5:
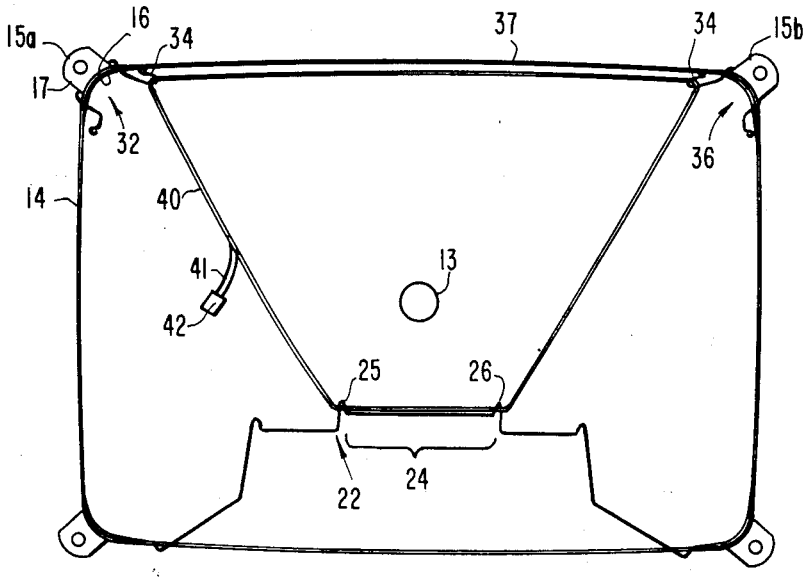
FIG. 5 is a rear elevational view of a cathode ray tube and mounting arrangement as shown in FIG. 2, illustrating another aspect of the operation of the mounting arrangement.
Figure 6:
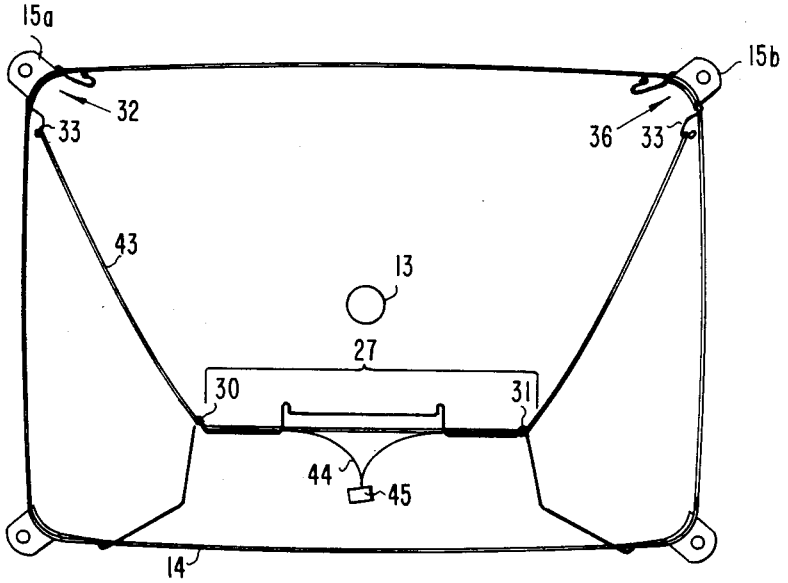
FIG. 6 is a rear elevational view of a cathode ray tube and mounting arrangement as shown in FIG. 2, illustrating another aspect of the operation of the mounting arrangement.

Referring to FIGS. 5 and 6, the operation of mounting and securing member 22 and retaining clips 32 and 36 will now be described. FIG. 5 shows member 22 and clips 32 and 36 in place for the purpose of mounting and retaining a degaussing coil 40. Degaussing coil 40 comprises a plurality of concentric wire loops wound to form a single coil. A downlead wire pair 41 and electrical terminal block 42 is shown for connecting the degaussing coil 40 to an appropriate source of degaussing current (not shown) within the associated video display apparatus. As can be seen in FIG. 5, degaussing coil 40 is held in place along the top of cathode ray tube 10 by being disposed within retaining or hook portion 34 of retaining clip 32 and 36. The length of degaussing coil extending between clips 32 and 36 is located close to the front of cathode ray tube 10, in the vicinity of the metallic shadow mask within front panel 11. Locating degaussing coil 40 in this position insures effective degaussing or demagnetization of the shadow mask.

Degaussing coil 40 is also secured via captivating or hook region 24 of member 22, as degaussing coil 40 fits and is held within the partial loops 25 and 26. Member 22 is required to be flexed somewhat when degaussing coil 40 is placed in position within hook region 24, so that the tension of member 22 acts to forcibly urge degaussing coil 40 firmly against the rear surface of cathode ray tube 10.

FIG. 6 illustrates mounting and securing member 22 and retaining clips 32 and 36 in place for the purpose of maintaining in position a cathode ray tube grounding wire or strap 43. Grounding strap 43, which may comprise a length of conductive wire braid, is connected to an appropriate ground point in the video display apparatus via downlead wires 44 and terminal block 45. In the arrangement shown in FIG. 6, member 22 is electrically conductive for the purpose of grounding both the electrically conductive surface coating on the cathode ray tube and the tension band. The two ends of ground strap 43 are held in place by retaining or hook portions 33 of retaining clips 32 and 36. A section of ground strap 43 intermediate the two ends is held in position by captivating or hook region 27 of member 22. The tension applied to member 22 when ground strap 43 is in position acts to hold ground strap 43 tightly against the surface of cathode ray tube 10.

It is of course possible to form member 22 and clips 32 and 33 in a manner that retains only degaussing coil 40 or ground strap 43. By providing means that allow retention of both degaussing coil 40 and ground strap 43 through common structural elements, however, an economical and efficient assembly results.

During assembly of the video display apparatus, it is desirable to apply ground strap 43 before mounting cathode ray tube 10 in an enclosure to facilitate ease of assembly. Degaussing coil 40 may be applied either before or after mounting of the tube into an enclosure.

The previously described retention arangement therefore provides an efficient and effective means for retaining a cathode ray tube degaussing coil and ground strap that requires few manual operations to implement, does not interfere with automatic tube mounting equipment, and requires very few parts.

What is claimed is:

1. An arrangement for a video display apparatus comprising:

a cathode ray tube having a circumferential band disposed about the perimeter of said cathode ray tube with a predetermined amount of tension applied thereto;

an electrical conductor disposed about the rear of said cathode ray tube and capable of being electrically connected to circuitry associated with said video display apparatus;

means for afixing the position of a first portion of said electrical conductor with respect to said cathode ray tube; and an elongated flexible member having first and second ends cooperating with said circumferential band for holding said member in position thereby, said member having retaining means intermediate said first and second ends for receiving and retaining said electrical conductor in order to afix the position of a second portion of said electrical conductor with respect to said cathode ray tube.

2. The arrangement defined in claim 1, wherein said flexible member is placed under tension when said electrical conductor is in position such that said electrical conductor is forcibly retained against the surface of said cathode ray tube.

3. The arrangement defined in claim 1, wherein said electrical conductor comprises a degaussing coil.

4. The arrangement defined in claim 1, wherein said electrical conductor comprises a grounding strap.

5. The arrangement defined in claim 1, wherein said first and second ends cooperate with said circumferential band near the corners of said cathode ray tube.

6. The arrangement defined in claim 1, wherein said retaining means comprises a hook.

7. An arrangement for a video display apparatus comprising:

a cathode ray tube having a circumferential band disposed about the perimeter of and afixed to said cathode ray tube;

an electrical conductor disposed about the rear of said cathode ray tube and capable of being electrically connected to circuitry associated with said video display apparatus;

clip means cooperating with and being held in position by said circumferential band and incorporating hook means for receiving and retaining said electrical conductor to afix a first portion thereof against said cathode ray tube; and an elongated flexible member engaging said electrical conductor at a plurality of locations for afixing a second portion of said electrical conductor against said cathode ray tube.

8. An arrangement for a video display apparatus comprising:

a cathode ray tube having a plurality of mounting lugs and a circumferential band disposed about the perimeter of said cathode ray tube with a predetermined amount of tension applied thereto, said band cooperating with said lugs to afix the position of said lugs with respect to said cathode ray tube;

a degaussing coil and a grounding strap, each disposed about the rear of said cathode ray tube;

means for afixing the position of first portions of said degaussing coil and said grounding strap with respect to said cathode ray tube;

a flexible member having first and second ends cooperating with said tension band for holding said member in position thereby, said member having separate retaining portions for receiving said degaussing coil and said grounding strap in order to afix the position of second portions of said degaussing coil and said ground strap with respect to said cathode ray tube.

9. The arrangement defined in claim 8, wherein said means for afixing the position of said first portions of said degaussing coil and said grounding strap comprises clip means for cooperating with said mounting lugs for being held in position thereby and first hook means for receiving and retaining said degaussing coil and second hook means for receiving and retaining said grounding strap.

10. The arrangement defined in claim 9, wherein said clip means comprises wire form means.

11. The arrangement defined in claim 10, wherein said first hook means comprises a first partial loop formed in said wire form means and said second hook means comprises a second partial loop formed in said wire form means.

* * * * *